United States Patent [19]

Huchtemann et al.

[11] Patent Number: 4,838,963

[45] Date of Patent: Jun. 13, 1989

[54] MICRO-ALLOYED STEELS

[75] Inventors: Bernd Huchtemann; Serosh Engineer; Volker Schüler, all of Krefeld, Fed. Rep. of Germany

[73] Assignee: Thyssen Edelstahlwerke AG, Krefeld, Fed. Rep. of Germany

[21] Appl. No.: 70,047

[22] Filed: Jul. 6, 1987

[30] Foreign Application Priority Data

Jun. 12, 1987 [DE] Fed. Rep. of Germany ..... 3719569
Jul. 5, 1987 [DE] Fed. Rep. of Germany ..... 3722735

[51] Int. Cl.[4] ..... C22C 38/28

[52] U.S. Cl. ..... 148/328; 148/333; 420/104; 420/126

[58] Field of Search ..... 148/328, 333; 420/126, 420/104

[56] References Cited

FOREIGN PATENT DOCUMENTS

| | | | |
|---|---|---|---|
| 1958548 | 11/1969 | Fed. Rep. of Germany . | |
| 2113418 | 3/1971 | Fed. Rep. of Germany . | |
| 56-38448 | 4/1981 | Japan | 420/104 |
| 57-16114 | 1/1982 | Japan | 148/333 |

*Primary Examiner*—Deborah Yee

*Attorney, Agent, or Firm*—Cushman, Darby & Cushman

[57] ABSTRACT

The invention relates to a micro-alloyed pearlitic steels contain 0.20 to 0.50% C, 0.40 to 1.0% Si, 0,80 to 1,80% Mn, 0.008 to 0.2% S, 0 to 0.7% Cr, 0 to 0.1% Al, 0 to 0.04% N, 0.01 to 0.05% Ti, remainder iron and impurities resulting from the melting process, with mixed sulphides (manganese, titanium carbonitrides, and the like) precipitated on the grain boundaries. The steel may preferably contain an additional content of up to 0.20% V and/or up to 0.10% Nb.

6 Claims, 3 Drawing Sheets

0.25%C 1.5% Mn

Nb, Nb+V V+Ti.

: 50 mm ø

: 8 mm 50 mm ø
1300°C 0.5 h/

V=100:1

MICRO-ALLOYED STEELS

The invention relates to micro-alloyed pearlitic steels for formed parts preferably obtained by forging at high temperatures.

(Percentages indicated in the text are mass %). The effect of a fine titanium nitride dispersion of low concentration on the resistance against grain growth is well known (C. J. Cuddy, J. C. Raley: "Austenite Grain Coarsening in Microalloyed Steels", Metallurgical Trans. A. Vol. 14 A, October 1983, P. 1989–1995). It is, however, hardly possible to make large-scale technical use of this effect, since at usual solidification speeds the temperature range between liquidus and solidus temperature is passed too slowly.

Object of the invention is to provide steels with a high fine grain resistance at temperatures of up to 1300° C. having high strength and toughness also in large-scale production.

Referring to the drawings.

The micro-alloyed pearlitic steels according to the invention contain 0.20 to 0.50% C, 0.40 to 1.0% Si, 0,80 to 1,80% Mn, 0.008 to 0.2% S, 0 to 0.7% Cr, 0 to 0.1% Al, 0 to 0.04% N, 0.01 to 0.05% Ti, remainder iron and impurities resulting from the melting process, with mixed sulphides (manganese, titanium carbonitrides, and the like) precipitated at the grain boundaries. The steel may preferably contain an additional content of up to 0.20% V and/or up to 0.10% Nb.

Suchlike steels can solidify at a solidification speed within the range of 3 to 25 mm/min whereby finely dispersed sulphides precipitate between liquidus and solidus temperatures on grain boundaries.

Figure 1:
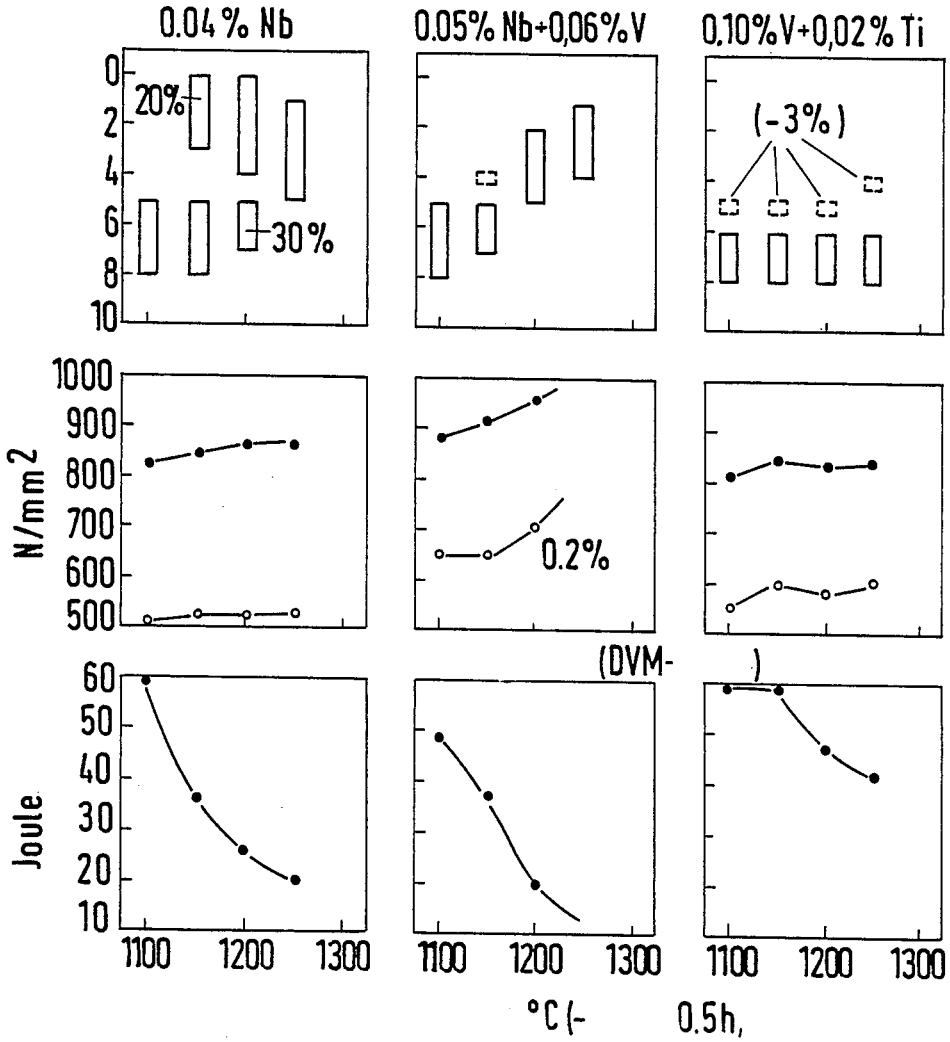
FIG. 1 shows the properties of steels with about 0.25% C and 1.5% Mn and additions of Nb, Nb+V and V+Ti. The dimension is 50 mm $\phi$ and the sample position is 8 mm beneath the surface.

The fine precipitates in this phase are responsible for the high fine grain resistance and the resulting combination of high strength and high toughness (FIG. 1).

A preferred steel composition is 0.20 to 0.35% C, 0.50 to 0.80% Si, 1.00 to 1.70% Mn, 0.01 to 0.09% S, 0.20 to 0.50% Cr, 0.015 to 0.06% Al, 0.015 to 0.030% N, 0.05 to 0.15% V and/or 0.02 to 0.10% Nb, 0.01 to 0.04% Ti, remainder iron including impurities resulting from the melting process.

Figure 2:
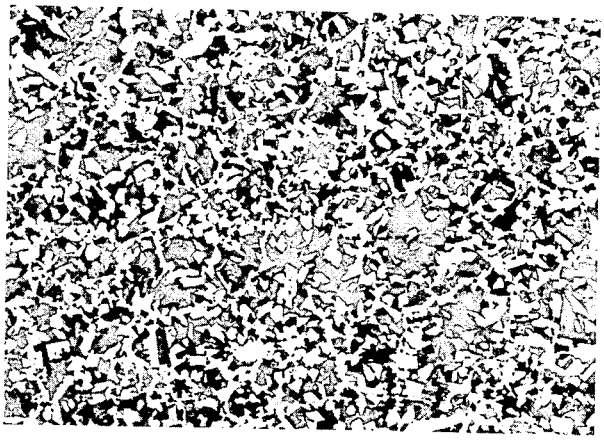
FIG. 2 is the microstructure of Steel G in the core of 50 mm $\phi$ after treatment at 1300° C. and 0.5 h/air.

It was found that only steels of the claimed composition have a high fine grain resistance at hot forming or annealing temperatures of up to 1300° C. (see FIGS. 1 and 2). The examples given in tables 2 and 3 clearly show that of all steels (composition see table 1) only the steels F and G which are subject matter of the invention present the excellent combination of high strength and high toughness. These steels have a tensile strength of at least 800 N/mm$^2$, a 0.2% yield strength of at least 550 N/mm$^2$, at least 15% elongation at rupture ($l_o$=5 $d_o$) and at least 45% reduction area. The notch impact values (determined on DVM samples) at room temperature are at least 35 Joule. Although the comparison steels A to E without titanium also have high strength, see table 2, they present an unsufficient toughness of less than 30 Joule, see table 3.

Steels of the following range are also preferred:

0.35 to 0.45% C, 0.5 to 0.8% Si, 1.0 to 1.7% Mn, 0.01 to 0.09% S, 0.2 to 0.5% Cr, 0.015 to 0.06% Al, 0.015 to 0.030% N, 0.05 to 0.15% V and/or 0.02 to 0.10% Nb, 0.01 to 0.04% Ti, remainder iron including impurities resulting from the melting process.

Figure 3:
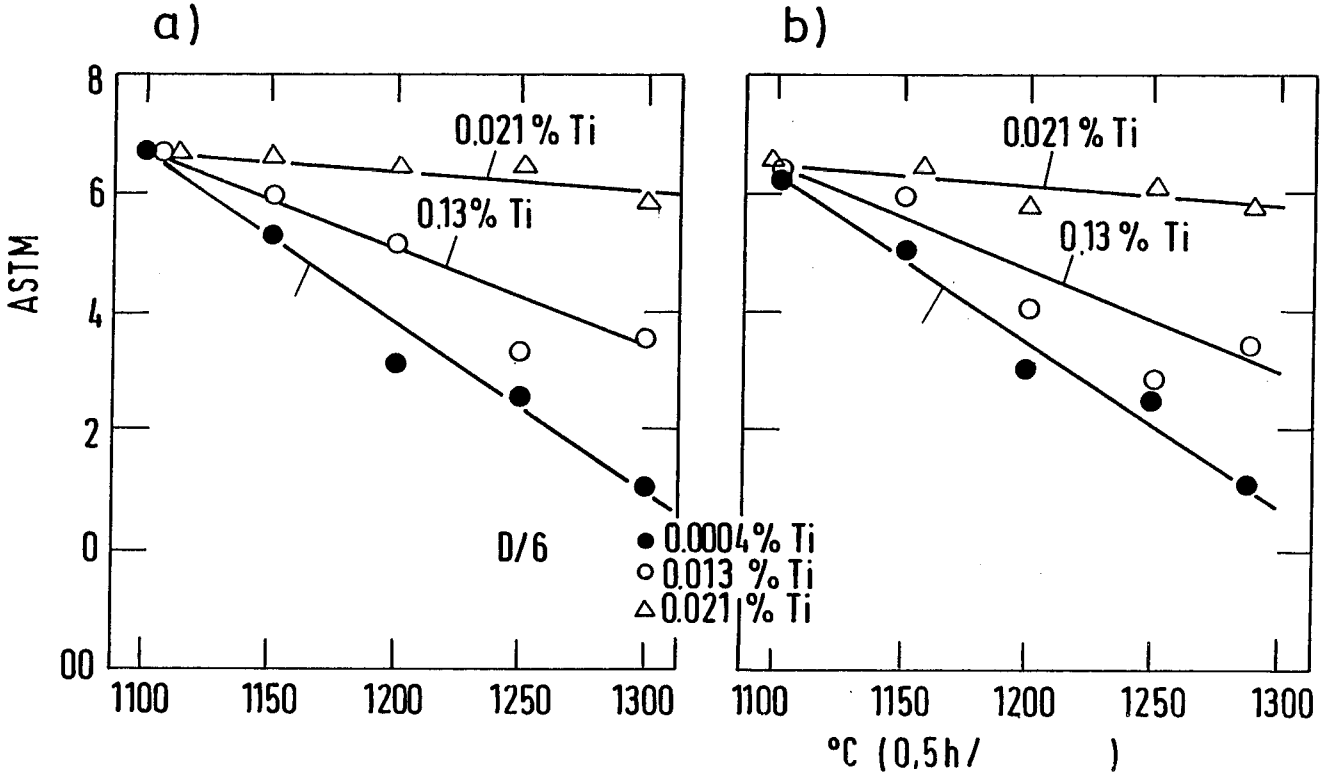
FIG. 3 shows the grain size of the steels of claim 4, without and with titanium. The dimension is 50 mm diameter.

It was found that these steels also have a high fine grain resistance at hot forming or annealing temperatures of up to 1300° C. (see FIG. 3).

The examples given in tables 4 and 6 (compositions see table 4) illustrate that only the steel I and J which are subject matter of the invention present the excellent combination of high strength and high toughness. These steels have a tensile strength of at least 850 N/mm$^2$, a 0.2% yield strength of at least 600 N/mm$^2$, at least 12% rupture elongation ($l_o$=5 $d_o$) and at least 40% reduction area rupture and a notch impact work on DVM samples at room temperature of at least 30 Joule. Comparison steel 4 without titanium showed with less than 22 Joule unsufficient toughness.

This combination of an even higher strength and good toughness of at least 30 Joule is unusual for micro-alloyed pearlitic steels.

Therefore, the steels which are subject matter of the invention are excellently suitable to be used as automobile structural parts.

Properties over the whole cross section until the core Dimensions of the steels: 50 mm diameter

TABLE 1

| | chem. composition in mass % | | | | | | | | | | |
|---|---|---|---|---|---|---|---|---|---|---|---|
| Steel | C | Si | Mn | P | S | Cr | Al | N | Nb | V | Ti |
| A | .26 | .54 | 1.37 | .005 | .014 | .40 | .043 | .019 | — | — | — |
| B | .24 | .51 | 1.57 | .012 | .031 | .58 | .016 | .022 | .04 | — | — |
| C | .26 | .61 | 1.48 | .005 | .009 | .31 | .014 | .031 | .05 | — | — |
| D | .25 | .53 | 1.34 | .005 | .013 | .37 | .032 | .020 | — | .09 | — |
| E | .25 | .64 | 1.44 | .006 | .024 | .35 | .012 | .016 | .04 | .05 | — |
| F(1) | .24 | .65 | 1.59 | .007 | .028 | .37 | .022 | .021 | .02 | .09 | .016 |
| G(1) | .27 | .66 | 1.43 | .014 | .036 | .10 | .024 | .017 | — | .10 | .018 |

TABLE 2

| | mechan. post-treatment properties | | | | | | | |
|---|---|---|---|---|---|---|---|---|
| | 1250° C. 2 h/air | | | | 1300° C. 2 h/air | | | |
| Steel | $R_{p\,0.2}$ N/mm$^2$ | $R_m$ N/mm$^2$ | $A_5$ % | Z % | $R_{p\,0.2}$ N/mm$^2$ | $R_m$ N/mm$^2$ | $A_5$ % | Z % |
| A | 574 | 841 | 15.3 | 41 | | | | |
| | 558 | 830 | 15.7 | 44 | | | | |
| B | 523 | 857 | 17.5 | 38 | | | | |
| | 539 | 889 | 16.3 | 28 | | | | |
| C | 504 | 862 | 19.7 | 36 | | | | |
| | 509 | 857 | 18.3 | 33 | | | | |
| D | 665 | 894 | 17.3 | 44 | | | | |
| | 622 | 883 | 15.0 | 49 | | | | |
| E | 610 | 899 | 12.0 | 36 | | | | |
| | 657 | 832 | 14.0 | 41 | | | | |
| F(1) | 608 | 859 | 16.7 | 62 | | | | |
| | 565 | 809 | 16.7 | 56 | | | | |
| G(1) | 571 | 811 | 21.2 | 64 | 550 | 809 | 22.0 | 66 |
| | 562 | 806 | 22.0 | 64 | 567 | 806 | 22.0 | 64 |

TABLE 3

| | notch bar impact work on DVM samples after treatment | | | | |
|---|---|---|---|---|---|
| Steel | 1250° C. 2 h/air $A_v$ in Joule | | | | 1300° C. 2 h/air $A_v$ in Joule |
| A | 9 | 13 | 20 | 27 | |
| B | 14 | 16 | 18 | 24 | |
| C | 17 | 19 | 19 | 23 | |
| D | 17 | 19 | 20 | 25 | |
| E | 7 | 8 | 12 | 13 | |
| F(1) | 35 | 38 | 47 | 60 | |

TABLE 3-continued

| Steel | notch bar impact work on DVM samples after treatment | | | | | | | |
|---|---|---|---|---|---|---|---|---|
| | 1250° C. 2 h/air $A_v$ in Joule | | | | 1300° C. 2 h/air $A_v$ in Joule | | | |
| G(1) | 55 | 57 | 59 | 64 | 39 | 44 | 46 | 53 |

(1)according to the invention

Properties over the whole cross section until the core Dimensions of the steels: 50 mm diameter

TABLE 4

| Steel | chem. composition in mass % | | | | | | | | | | |
|---|---|---|---|---|---|---|---|---|---|---|---|
| | C | Si | Mn | P | S | Cr | Al | N | Nb | V | Ti |
| H | .35 | .66 | 1.35 | .008 | .043 | .23 | .025 | .015 | .02 | .09 | — |
| I(2) | .35 | .66 | 1.36 | .008 | .045 | .23 | .023 | .016 | .02 | .09 | .013 |
| J(2) | .34 | .75 | 1.33 | .006 | .055 | .27 | .008 | .018 | — | .09 | .021 |

TABLE 5

| Steel | mechan. post-treatment properties | | | | | | | |
|---|---|---|---|---|---|---|---|---|
| | 1250° C. 2 h/air | | | | 1300° C. 2 h/air | | | |
| | $R_{p\,0,2}$ N/mm² | $R_m$ N/mm² | $A_5$ % | Z % | $R_{p\,0,2}$ N/mm² | $R_m$ N/mm² | $A_5$ % | Z % |
| H | 628 | 923 | 15.8 | 38 | 651 | 944 | 12.8 | 22 |
| | 622 | 921 | 16.2 | 39 | 624 | 921 | 11.4 | 20 |
| I(2) | 606 | 889 | 20.8 | 54 | 609 | 894 | 20.8 | 54 |
| | 605 | 886 | 20.6 | 56 | 603 | 896 | 20.2 | 51 |
| J(2) | 612 | 873 | 19.8 | 56 | 617 | 851 | 20.0 | 56 |
| | 602 | 865 | 20.0 | 56 | 605 | 859 | 24.6 | 56 |

TABLE 6

| Steel | notch bar impact work on DVM samples after treatment | | | | | | | |
|---|---|---|---|---|---|---|---|---|
| | 1250° C. 2 h/air $A_v$ in Joule | | | | 1300° C. 2 h/air $A_v$ in Joule | | | |
| H | 13 | 15 | 17 | 18 | 13 | 16 | 20 | 21 |
| I(2) | 30 | 35 | 38 | 40 | 30 | 31 | 34 | 37 |
| J(2) | 40 | 47 | 49 | 59 | 35 | 38 | 42 | 44 |

(2)according to the invention

We claim:

1. Micro-alloyed structural steel having a pearlite microstructure and a high grain resistance of up to 1300° C., containing

| | |
|---|---|
| 0.2 to 0.5 | % carbon |
| 0.4 to 1.0 | % silicon |
| 0.8 to 1.8 | % manganese |
| 0.008 to 0.2 | % sulphur |
| 0 to 0.7 | % chromium |
| 0 to 0.1 | % aluminum |
| 0 to 0.04 | % nitrogen |
| 0.01 to 0.05 | % titanium |

the remainder being iron and impurities resulting from the melting process and whereby sulfide prrecipitates are at the grain boundaries.

2. Steel according to claim 1, which is characterized by an additional content of vanadium of up to 0.2% and/or niobium of up to 0.1%.

3. Steel according to claim 2 with 0.20 to 0.35% C, 0.5 to 0.8% Si, 1.0 to 1.7% Mn, 0.01 to 0.09% S, 0.2 to 0.5% Cr, 0.015 to 0.06% Al, 0.015 to 0.030% N, 0.05 to 0,15% V and/or 0.02 to 0.10% Nb, 0.01 to 0.04% Ti, remainder iron including impurities resulting from the melting process presenting a high fine grain resistance at hot forming or annealing temperatures of up to 1300° C. and a tensile strength of at least 800 N/mm², 0.2% yield strength of at least 550 N/mm², an elongation rupture of at least 15%, and a reduction of area upon rupture of at least 45% in case of notch bar impact work at a room temperature of at least 35 Joule on DVM samples.

4. Steel according to claim 2 with 0.35 to 0.45% C, 0.5 to 0.8% Si, 1.0 to 1.7% Mn, 0.01 to 0.09% S, 0.2 to 0.5% Cr, 0.015 to 0.06% Al, 0.015 to 0.030% N, 0.005 to 0.15% V and/or 0.02 to 0.10% Nb, 0.01 to 0.04% Ti, remainder iron including impurities resulting from the melting process, with a high fine grain resistance at hot forming or annealing temperatures of up to 1300° C. and a tensile strength of at least 850 N/mm², a 0.2% yield strength of at least 600 N/mm², an elongation at rupture of at least 12%, and a reduction of area rupture of at least 40% in case of notch bar impact work at at room temperature of at least 25 Joule on DVM samples.

5. Automobile structural parts comprising the steel according to one of claims 1–4.

6. A steel article comprising the steel of claim 1 which has been solidified at a solidification speed of 3 to 25 mm/min.

* * * * *